US007377856B2

(12) United States Patent
Nickelson

(10) Patent No.: US 7,377,856 B2
(45) Date of Patent: May 27, 2008

(54) PLAYGROUND APPARATUS

(75) Inventor: David Nickelson, Scandia, MN (US)

(73) Assignee: Xccent Corporation, Osceola, WI (US)

( * ) Notice: Subject to any disclaimer, the term of this patent is extended or adjusted under 35 U.S.C. 154(b) by 37 days.

(21) Appl. No.: 11/454,079

(22) Filed: Jun. 15, 2006

(65) Prior Publication Data

US 2007/0011954 A1 Jan. 18, 2007

Related U.S. Application Data

(60) Provisional application No. 60/690,765, filed on Jun. 15, 2005.

(51) Int. Cl.
*A63G 17/00* (2006.01)
*A63G 1/32* (2006.01)

(52) U.S. Cl. ..... 472/106; 472/135; 482/34

(58) Field of Classification Search ..... 472/48, 472/106, 109, 110; 482/34, 35
See application file for complete search history.

(56) References Cited

U.S. PATENT DOCUMENTS 1,263,917 A * 4/1918 Mills ..... 472/106
1,537,686 A 5/1925 Lynn
4,378,112 A 3/1983 Goldstein ..... 272/111
5,037,086 A * 8/1991 Strand ..... 482/34
5,277,450 A * 1/1994 Henschen ..... 280/6.151
5,364,313 A * 11/1994 Nickelson ..... 472/135
6,003,888 A * 12/1999 Godbersen ..... 280/124.169

* cited by examiner

*Primary Examiner*—Kien T Nguyen
(74) *Attorney, Agent, or Firm*—Jacobson and Johnson; Thomas N. Phung

(57) ABSTRACT

A playground apparatus comprising at least three separate elongated plank extending in a generally horizontally spaced end-to-end relationship, at least one pivotal support member for pivotally supporting each of the elongated plank in vertically spaced relationship above a support surface for vertical pivotal movement of opposite ends of the elongated planks, and at least two resiliently flexible living hinges each providing a void-free connection between adjacent ends of the elongated planks to eliminate a pinch point while providing for simultaneous vertical movement of said elongated planks.

20 Claims, 8 Drawing Sheets

PLAYGROUND APPARATUS

CROSS REFERENCE TO RELATED APPLICATIONS

This application claims priority to currently pending U.S. Provisional Application Ser. No. 60/690,765; filed on Jun. 15, 2005; titled PLAYGROUND APPARATUS.

STATEMENT REGARDING FEDERALLY SPONSORED RESEARCH OR DEVELOPMENT

None

REFERENCE TO A MICROFICHE APPENDIX

None

FIELD OF THE INVENTION

This invention relates generally to playground apparatus and, more specifically, to a teeter-totter-like playground apparatus having at least three pivotally mounted elongated planks that are connected with the connecting regions of the elongated planks providing for a void-free connection so as to eliminate any potential pinch point thereabout.

BACKGROUND OF THE INVENTION

Pivoting playground apparatus such as teeter-totters or seesaws are well known in the art. Teeter-totters or seesaws generally comprise an elongated beam pivotally supported above the ground at a midpoint between the ends of the beam by a base for up and down pivotal movement of the ends of the beam relative to the ground. That is, the aforementioned support of the elongated beam enable the ends of the beam to move alternately from a ground abutting or a ground adjacent position to an elevated position such that the elevated end if spaced a substantial distance above the ground. Use of the aforementioned requires a minimum of two people, preferably of similar weight, with each person position at each end of the beam.

Teeter-totter or seesaw apparatus having multiple pivotally mounted elongated beams are also known in the art. An example of the aforementioned is described in U.S. Pat. No. 4,378,112, which teaches a see-saw apparatus having multiple pivotally mounted elongated beams that are resiliently interconnected to each other by a flexible connecting tubular sleeve to enable simultaneous upward and downward movement of each beam member in unison throughout the entire composite length of the interconnected beam members.

Although the aforementioned flexible connecting tubular sleeve work for its intended purpose, namely to allow the connecting ends of the mounted elongated beams to move up and down through the flexing action of the tubular sleeve, one of the problems associated with the use of the tubular sleeve is that the flexing action of the tubular sleeve forms an opening or void at the ends of the tubular sleeve, which could lead to a potential pinch point. That is, since the see-saw apparatus is intend to be used by children, who are curious by nature, it would not be unconceivable that children using the aforementioned see-saw apparatus would stick their fingers into the opening or void thereby leading to their fingers being pinch.

BRIEF SUMMARY OF THE INVENTION

Figure 1:
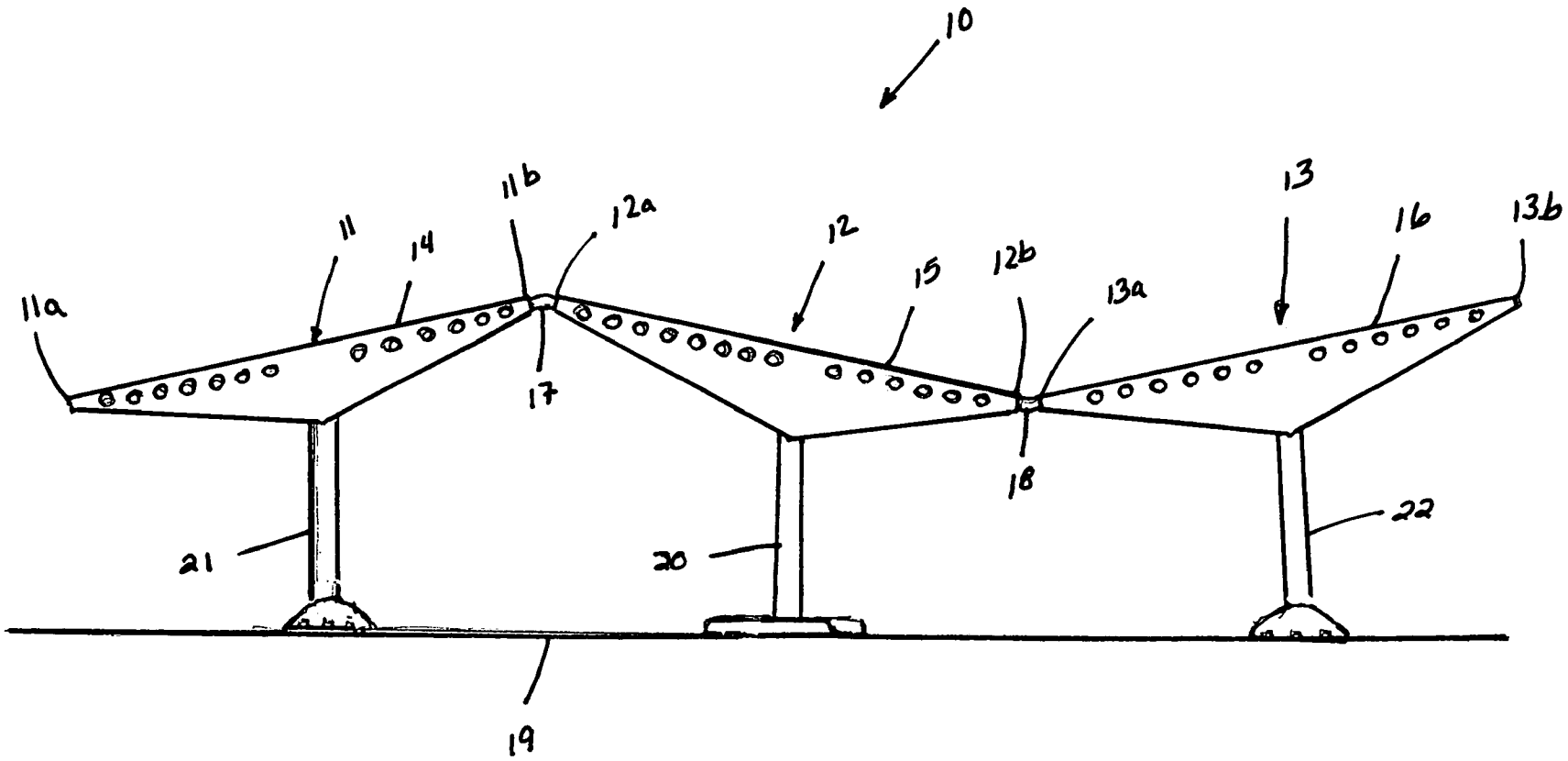
FIG. 1 shows an embodiment of a playground apparatus of the present invention.

The present invention comprises a playground apparatus having a first elongated plank, a second elongated plank, and a third elongated plank, a first pivotal support member for pivotally supporting the first elongated plank, a second pivotal support member for pivotally supporting the second elongated plank, and a third pivotal support member for pivotally supporting the third elongated plank whereby each of said elongated plank are pivotally supported in vertically spaced relationship above the ground for vertical pivotal movement of the opposite ends of the elongated planks. The playground apparatus includes a first resiliently flexible living hinge connecting an end of the first elongated plank to an end of the second elongated plank, and a second resiliently flexible solid living hinge connecting an end of the second elongated plank to an end of the third elongated plank with the living hinges providing a void-free connection between the ends of the elongated plank so as to eliminate a pinch point while providing for simultaneous vertical movement of said elongated planks.

The second pivotal support member of the playground apparatus can include a torsion axle located proximal the second elongated plank to allow for the pivotally movement of the second elongated plank about the second pivotal support member with the torsion axle having a set of resiliently flexible damping members located therein to slow and limit the pivotal motion of the second elongated plank.

The first pivotal support member and the third pivotal support of the playground apparatus each can include a torsion axle located proximal a support surface to allow for the pivotally movement of the pivotal support members. Similar to the torsion axle of the second pivotal support member, the torsion axles of the first pivotal support member and the third pivotal support member each also can include a set of resiliently flexible damping members located therein to slow and limit the pivotal motion of said first and third pivotal support members.

DESCRIPTION OF THE PRIOR ART

U.S. Pat. No. 1,263,917 teaches a seesaw having an improved means for mounting the rocking member on the pedestal;

U.S. Pat. No. 1,537,686 teaches an amusement device that includes three platforms, one of which is supported on a surface by rollers; and U.S. Pat. No. 4,378,112 teaches a play apparatus comprising at least three beam members pivotally mounted above the ground with adjacent ends of the each beam interconnected by a resilient sleeve.

DESCRIPTION OF THE PREFERRED EMBODIMENT

Generally, the present invention comprises a playground apparatus similar to the traditional seesaw or teeter-totter but having at least three interconnected pivotally mounted elongated planks. The elongated planks, when connected to each other, preferably extends in a linear fashion forming to a linear shaped device with the connecting regions of the elongated planks providing for a void-free connection between the ends of the planks so as to eliminate any potential pinch point thereabout. A feature of providing for at least three interconnected pivotally mounted elongated planks of the present invention is that unlike traditional one plank teeter-totter, since the present invention includes at least three separate cooperatively connected elongated planks which may be installed in a straight line or with a slight inclination between the elongated planks, the present playground apparatus does not require at least two users in order to operate the apparatus. In addition, one end of the plank does not automatically fall to the ground merely because one of the users gets off the opposing end of the elongated plank.

Referring to FIG. 1, FIG. 1 shows an embodiment of a playground apparatus 10 of the present invention. The playground apparatus 10, as shown in the embodiment of FIG. 1, includes a first elongated plank 11, a second elongated plank 12, and a third elongated plank 13 with the aforementioned elongated planks each having a supporting surface 14, 15, and 16 for enabling one or more user to walk, sit, stand, and/or otherwise play along any portion of the elongated plank. It is noted that elongated planks 11, 12, and 13 can be made from a plurality of materials including but not limited to wood, plastic, and metal. It is noted that the elongated planks can be coated with a weatherproof material such as but not limited to a plastic coating, a rubberized coat and a vinyl or vinyl-like material to extend the life of the elongated planks such as by reducing rust and corrosion. An example of the aforementioned material comprises a poly vinyl chloride coating. It is further noted that although playground apparatus of the present invention will be further described as comprising three elongated planks, alternative embodiment of the present invention can include playground apparatuses comprising more than three elongated planks with the number of elongated planks preferably comprising an odd number of elongated planks.

In the embodiment of FIG. 1, the first elongated plank 11 is shown connected to the second elongated plank 12 by a first living hinge 17 and the second elongated plank 12 is shown connected to the third elongated plank 13 by a second living hinge 18. In regards to living hinges 17 and 18, the living hinges 17 and 18 of the present invention preferably comprise a solid high strength resiliently flexible material such as but not limited to an elastomer or the like that is capable of flexing and bending while being weather resistant and cut resistant. Although a plurality of flexible materials can be used, an example of the aforementioned include but is not limited to Andur® 90-AP and Andur® 95-AP which are elastomers comprising a polymer (PTMG) based liquid, toluene diisocyanate terminated prepolymer produced and sold by Anderson Development Company, a company located in Adrian, Mich.

Second elongated plank 12 is shown in FIG. 1 as pivotally supported above a support surface such as a ground 19 between the ends 12*a* and 12*b* of the second elongated plank 12 and preferably at a midpoint region between the ends 12*a* and 12*b* by a pivot supporting central member 20. Pivot supporting central member 20 functions to provide for up and down pivotal movement of the ends 12*a* and 12*b* of the second elongated plank 12 relative to ground 19.

First elongated plank 11 and third elongated plank 13 are also shown as each pivotally supported above the ground 19 with the first elongated plank 11 supported above the ground 19 between the ends 11*a* and 11*b* of the first elongated plank 11, and preferably at a midpoint region between the ends 11*a* and 11*b* by a first pivot supporting leg 21 and the third elongated plank 13 supported above the ground 19 between the ends 13*a* and 13*b* of the third elongated plank 13 and preferably at a midpoint region between the ends 13*a* and 13*b* by a second pivot supporting leg 22. Similar to the pivot supporting central member 20, the first and second pivot supporting legs 21 and 22 provide for up and down pivotal movement of the ends 11*a* and 11*b* of the first elongated plank 11 and the ends 13*a* and 13*b* of the third elongated plank 13 relative to the ground 19.

It is noted that the elongated planks 11, 12, and 13 of the present invention can be supported at almost any height, although it is preferred that the elongated planks be supported close to the ground to reduce injuries to children users who happens to fall off of playground apparatus 10 but high enough from ground 19 so that the ends of the planks 11, 12, and 13 do not engage ground 19 or even come close to ground 19 to form a potential crushing point. In general, it is preferred that the ends of the planks 11, 12, and 13 is about at least six inches or greater and preferably twelve inches or greater from ground 19 at all times.

Figure 2:
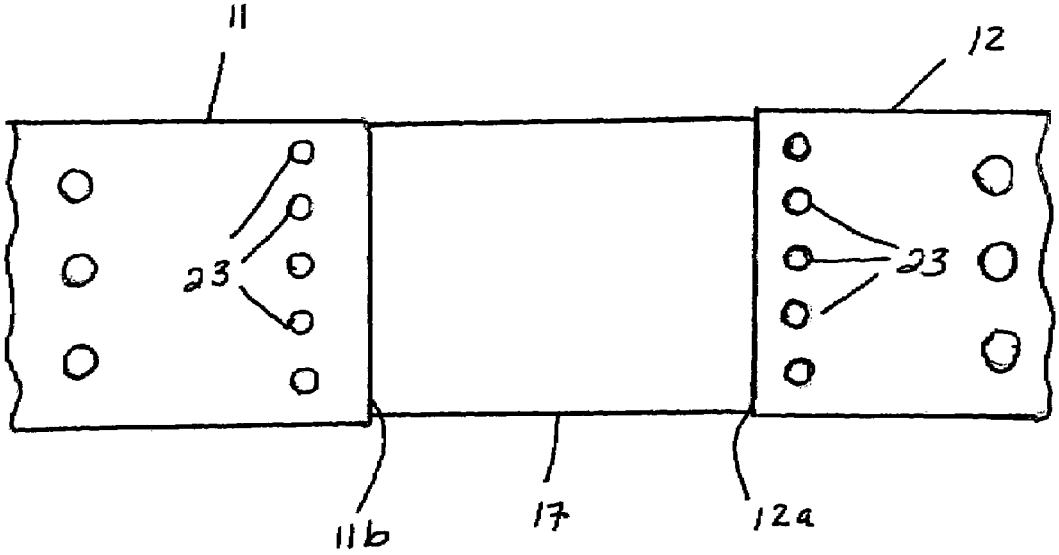
FIG. 2 shows a top view of a living hinge connecting a first elongated plank to a second elongated plank.
Figure 3:
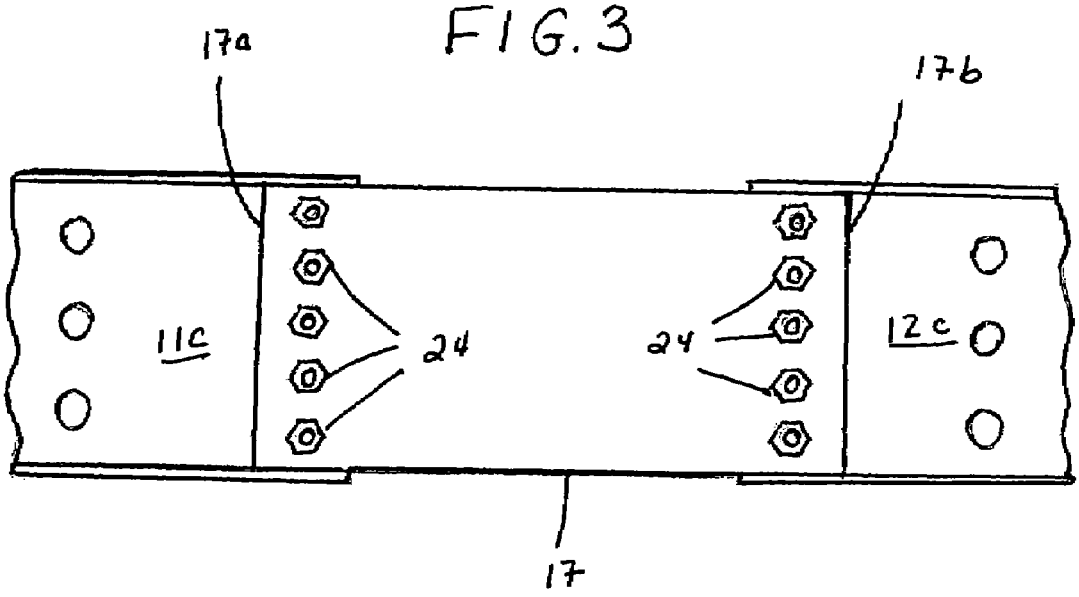
FIG. 3 shows a bottom view of the living hinge connecting the first elongated plank to the second elongated plank.

Referring to FIGS. 2 and 3, FIG. 2 shows a top view and FIG. 3 shows a bottom view of the connection between the first elongated plank 11 and the second elongated plank 12 by first living hinge 17. It is noted that while there are multiple living hinges connecting multiple elongated planks to each other, only the connection between the first elongated plank 11 and the second elongated plank 12 will be further discussed as the connection between each of the elongated planks will preferably be similar throughout playground apparatus 10.

Referring to the first living hinge 17, it is noted that while the living hinges of the present invention can be secured to the ends of the elongated planks to provide for their connection by a variety of methods including but not limited to being glued to, extruded to, or molded to the ends of the elongated planks, the embodiment of FIGS. 2 and 3 shows first living hinge 11 secured to the ends 11*b* and 12*a* of first elongated plank 11 and second elongated plank 12 through the use of a plurality of bolts 23 and nuts 24 thereby forming a one-piece linear shaped. More specifically, a portion of first living hinge 17 proximal a first end 17*a* of the first living hinge 17 is shown in FIG. 3 engaging an underside 11*c* of first elongated plank 11 with first living hinge 17 secured to the first elongated plank 11 by a series of nuts 24 and bolts 23. Similarly, a portion of the first living hinge 17 proximal a second end 17*b* of the first living hinge 17 is shown engaging an underside 12*c* of the second elongated plank 12 with the first living hinge 17 also secured to the second elongated plank 12 by a series of nuts 24 and bolts 23. Alternative embodiments can include bolts that are pre-welded to the elongated planks to provide for an elongated plank having a smooth top surface.

A feature of the present invention is that the living hinges 17 and 18 are secured to the elongated planks 11, 12, 13 in a condition to provide for a void-free connection between the living hinges 17 and 18 and the connecting ends 11*b*, 12*a*, 12*b*, 13*a* of the elongated planks 11, 12, 13 to prevent voids regions thereabout thereby eliminating potential pinch points around the aforementioned regions while flexing and bending to provide for simultaneous vertical movement of the elongated planks 11, 12, and 13.

Figure 4:
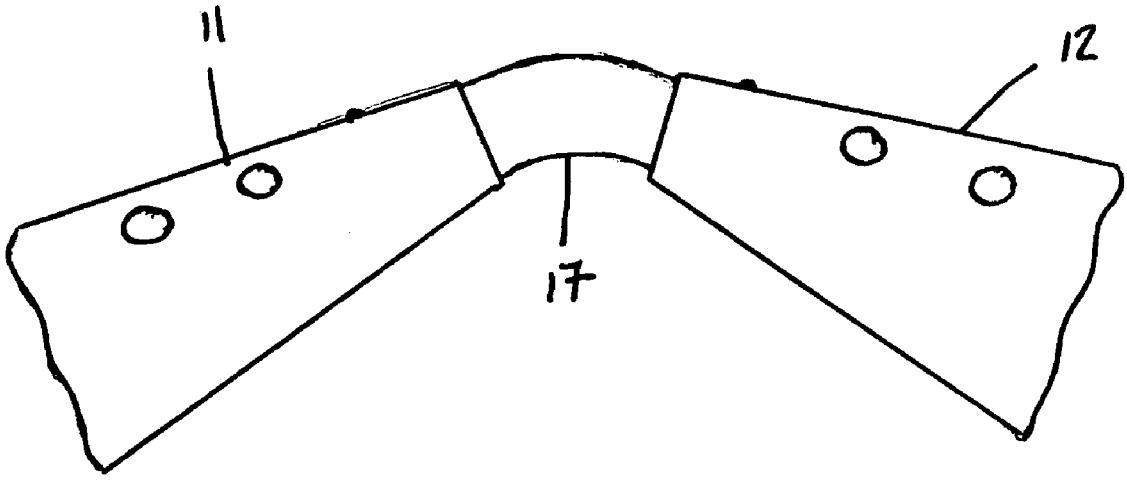
FIG. 4 shows a close-up view of the connection between the first elongated plank and the second elongated plank of the playground apparatus of FIG. 1.
Figure 5:
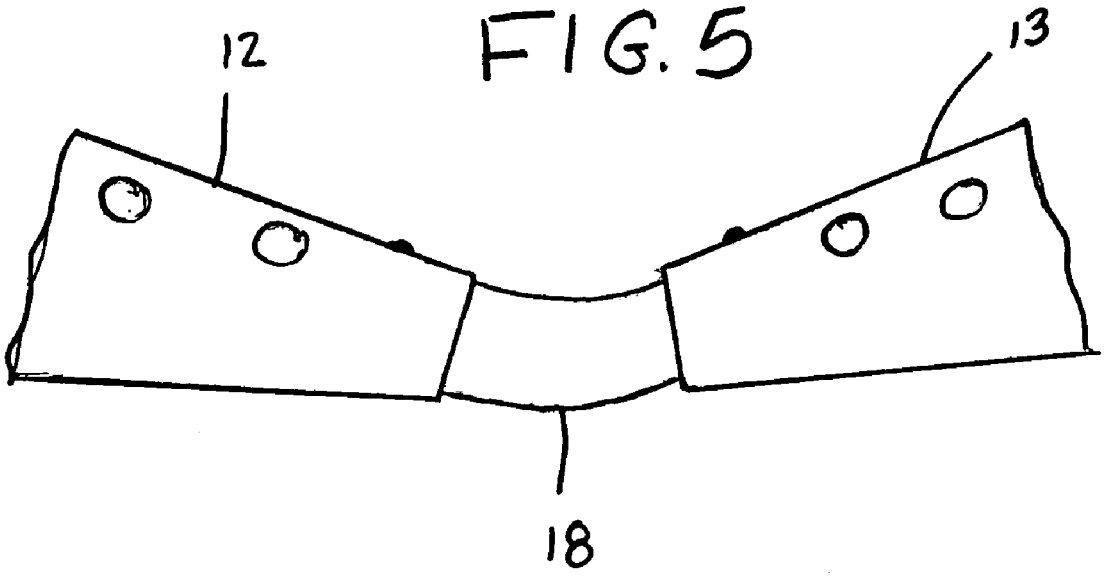
FIG. 5 shows a close-up view of the connection between the second elongated plank and the third elongated plank of the playground apparatus of FIG. 1.

Referring to FIGS. 4 and 5, FIG. 4 shows a close-up view of the connection between first elongated plank 11 and second elongated plank 12 of playground apparatus 10. FIG. 5 shows a close-up view of the connection between second elongated plank 12 and third elongated plank 13 of playground apparatus 10 of FIG. 1. Referring to FIG. 4, note that in FIG. 4 the adjacent ends 11*b* and 12*a* of the first and second planks 11 and 12 are shown in a raise condition thereby causing first living hinge 17 to bend or flex and bow upwards. Conversely, FIG. 5 shows the adjacent ends 12*b* and 13*a* of second and third planks 12 and 13 in a lowered condition thereby causing second living hinge 18 to flex or bend and bow downwards.

Figure 6:
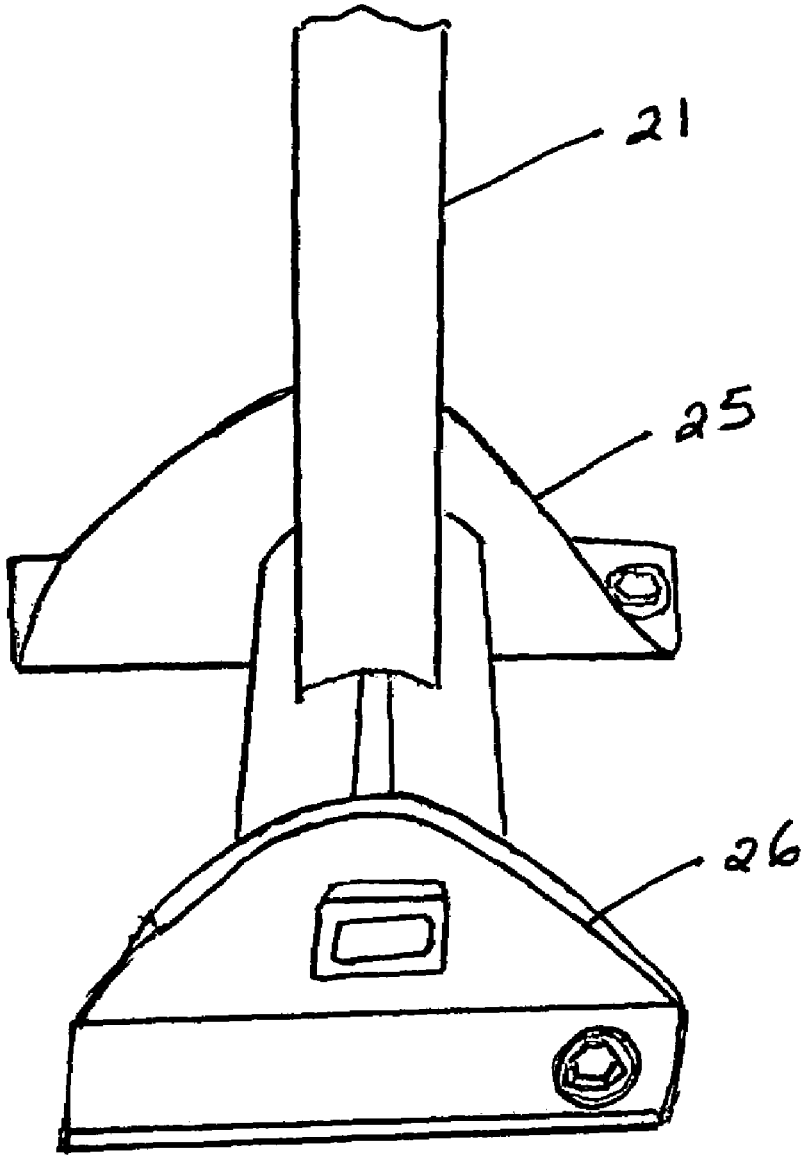
FIG. 6 shows a close-up perspective view of a lower portion of the pivot supporting leg.

FIG. 6 shows a close-up perspective view of a lower portion of the pivot supporting leg 21. The lower portion of pivot supporting leg 21 is shown in the embodiment of FIG. 6 as including a pair of floor brackets 25 and 26, which are secured to corresponding regions on the pivot supporting leg 21 and are bolted to a support surface to provide stability to pivot supporting leg 21 and the respective pivotable elongated plank.

Figure 7:
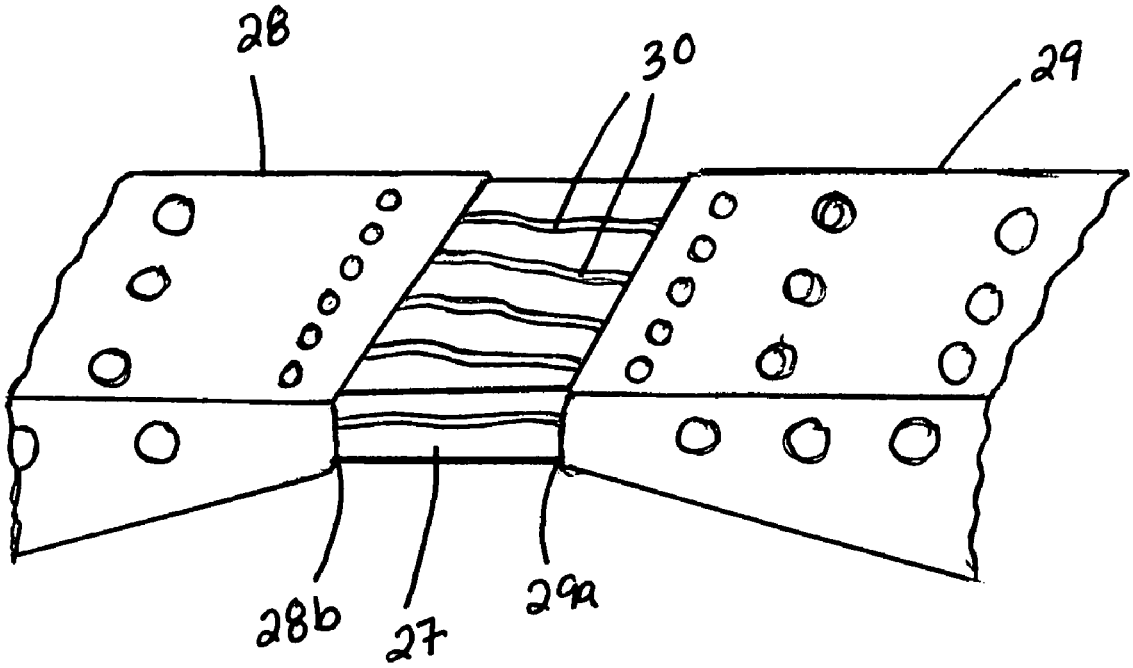
FIG. 7 shows an alternative embodiment of a living hinge having a plurality of metal wires located to prevent vandalism.

FIG. 7 shows an alternative embodiment of a living hinge 27 of the present invention connecting the adjacent ends 28*b* and 29*a* of a pair of planks 28 and 29 to each other similar to the first living hinge 17 of FIGS. 2 and 3. Note however that in the embodiment of FIG. 7, living hinge 27 is shown to include a plurality of metal wires 30 or the like embedded therein. The presence of metal wire 30 located within living hinge 27 functions to deter vandalism by preventing vandals from completely slicing through living hinge 27, such as with a knife, to damage the playground apparatus 10 of the present invention. It is noted that other materials can be implanted in the living hinge to prevent vandalism so long as the implanted material is resistant from being cut while still allowing the living hinge to flex and bend.

In use of playground apparatus 10, each elongated plank 11, 12, and 13 is pivotally movable in see-saw fashion with all connected ends 11*b*, 12*a*, 12*b*, and 13*a* of the elongated planks 11, 12, and 13 being constrained by the flexibly resilient living hinges 17 and 18 to prevent the connecting ends 11*b*, 12*a*, 12*b*, and 13*a* of the elongated planks 11, 12, and 13 of playground apparatus 10 from engaging ground 19 while also causing the adjacent end and connecting ends 11*b*, 12*a*, 12*b*, and 13*a* of the elongated planks 11, 12, and 13 to move in unison thereby providing for a harmonic wave-like motion.

That is, when one of the connected ends of the elongated planks 11, 12, and 13 move upwardly or downwardly, the adjacent connected end of the elongated plank 11, 12, and 13 also move in the same or a similar direction. In addition, when any part of the elongated plank 11, 12, and 13 is loaded in a condition, which creates a pivotal movement of one plank, all other planks are correspondingly moved. For example, if a user sits on the first end 11*a* of first elongated plank 11, the first end 11*a* of the first elongated plank 11 will move downwardly causing the second end 11*b* of the first elongated plank 11 to move upwardly. The first end 12*a* of the second elongated plank 12, being connected to the second end 11*b* of the first elongated plank 11 will be moved upwardly with the second end 11*b* of the first elongated plank 11 thereby causing the second end 12*b* of the second elongated plank 12 to move downwardly. Since the first end 13*a* of the third elongated plank 13 is connected to the second end 12*b* of the second elongated plank 12, the first end 13*a* of the third elongated plank 13 will follow the second end 12*b* of the second elongated plank 12 and moved downwardly thereby causing an opposing second end 13*b* of the third elongated plank 13 to move upwardly.

It is noted that the movement of the elongated planks 11, 12, and 13 will vary depending on the position of the user on the elongated plank 11, 12, and 13 along with the number of users sitting on the elongated planks 11, 12, and 13. Thus, movement of an end of the elongated plank sets off a chain reaction throughout the elongated planks and living hinges thereby resulting in the movement of the playground apparatus in a harmonic motion.

That is, when an end of any plank member goes down, the other end goes up and causes a similar up and down effect on all other plank members. Again, it is noted that the planks can be made in different lengths, and more than three planks can be employed. The living hinges are sufficiently strong to cause movement of all the elongated planks even when there are opposing forces caused by persons at opposite ends of the apparatus.

Figure 8:
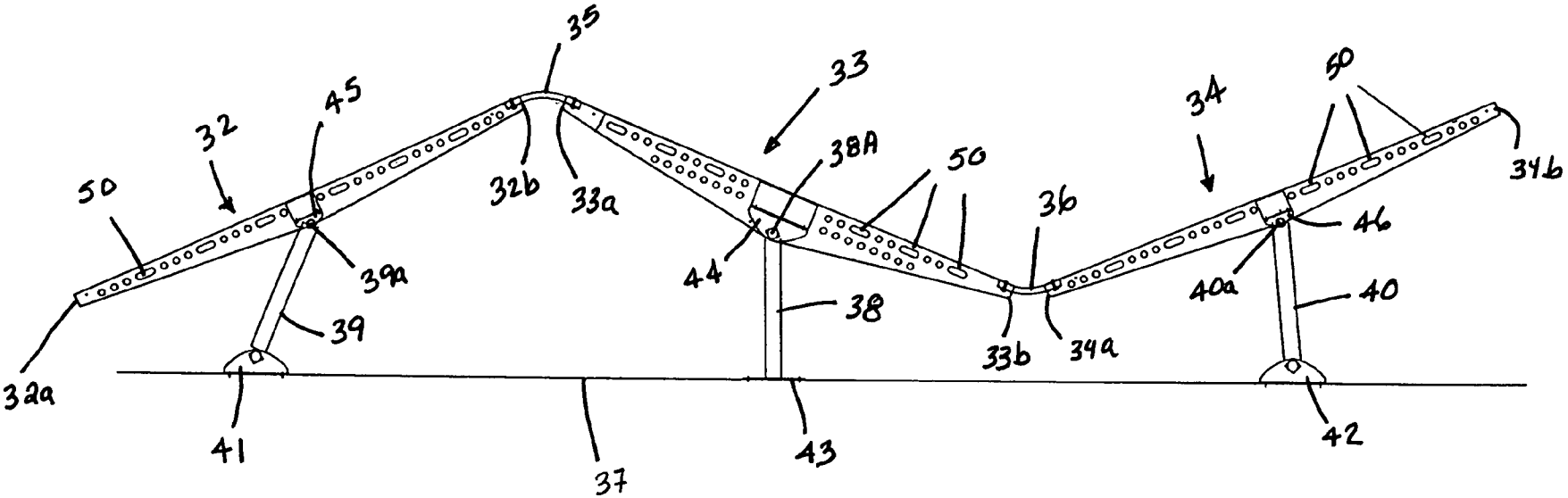
FIG. 8 shows an alternative embodiment of a playground apparatus.

FIG. 8 shows an alternative embodiment of a playground apparatus 31 of the present invention. Playground apparatus 31 is similar to the playground apparatus 10 of FIG. 1 in that playground apparatus 31 includes a first elongated plank 32, a second elongated plank 33, and a third elongated plank 35. The elongated planks 32, 33, and 34 each include integrated handholds or handles 50 located on the sides of the elongated planks 32, 33, and 34 to help users maintain their balance on playground apparatus 31 during use. First elongated plank 32 is connected to the second elongated plank 33 by a first living hinge 35 and second elongated plank 33 is connected to third elongated plank 34 by a second living hinge 36. Similar to the living hinges 17 and 18 of playground apparatus 10, living hinges 35 and 36 preferably comprises a high strength resiliently flexible material that is capable of flexing and bending while being weather resistant and cut resistant.

Figure 9:
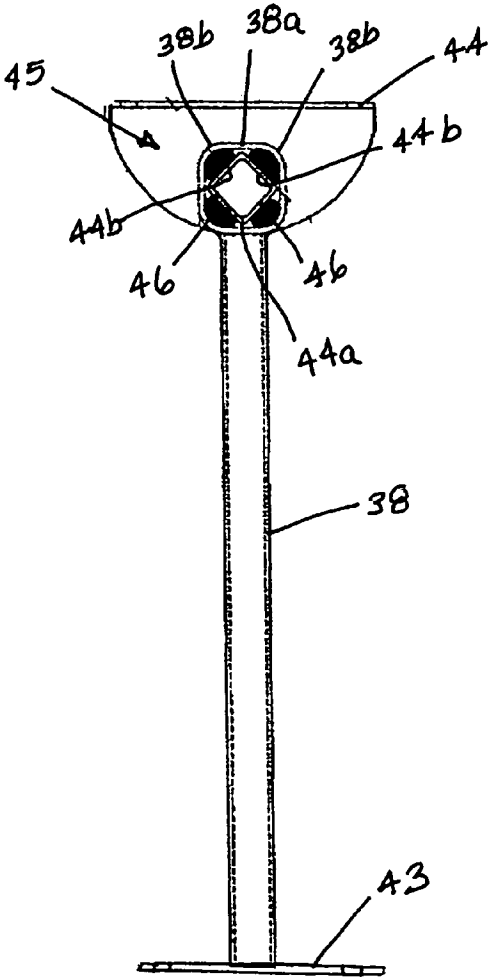
FIG. 9 shows a close-up cross-sectional view of the mating of a pivot supporting central member to a mounting bracket of the playground apparatus of FIG. 8.

Second elongated plank 33 is pivotally supported above a support surface 37 between the ends 33*a* and 33*b* of second elongated plank 33 by a pivot supporting central member 38, which is mounted to support surface 37 by a ground bracket 43. As shown in FIGS. 8 and 9, pivot supporting central member 38 includes a hollow arm 38*a* extending from an end of central member 38 that is distal to ground bracket 43. Hollow arm 38*a* of pivot supporting central member 38 functions by matingly encompassing with a mounting bracket 44, and more specifically, a bar 44*a* of mounting bracket 44 located proximal the underside of second plank 33 to form a torsion axle 45. In is noted that mounting bracket 44 is preferable embedded into the underside of second elongated plank 33 to eliminate a pinch point. The mating between the bar 44*a* of mount bracket 44 of the second panel 33 and the hollow arm 38*a* of pivot supporting central member 38 enables pivot supporting central member 38 to support second elongated plank 33 above the ground while also providing for the pivotally movement of the second elongated plank 33 thereabout.

Referring to FIG. 9, it is noted that the embodiment of torsion axle 45 of FIG. 9 shows bar 44*a* of mounting bracket 44 and hollow arm 38*a* of pivot supporting central member 38 both comprising a square shaped cross-section with hollow arm 38*a* positioned around bar 44*a* such that in a rest condition the sidewalls 44*b* of bar 44*a* face the corners 38*b* of hollow arm 38*a*. In order to slow down and limit the pivotal movement of the second elongated plank 33 about pivot supporting central member 38 in order to guard against potential injuries, torsion axle 45 includes a set of resiliently flexible damping members 46 located in the spaces formed between the sidewalls 44*b* of bar 44*a* and the corners 44*b* of the arm 38*a*.

Referring to back to FIG. 8, the first elongated plank 32 and the third elongated plank 34 are each also shown pivotally supported above support surface 37 with first elongated plank 32 supported above support surface 37 between the ends 32*a* and 32*b* by a first pivot supporting leg 39 and third elongated plank 34 supported above support surface 37 between the ends 34*a* and 34*b* by a second pivot supporting leg 40. First pivot supporting leg 39 is mounted to support surface 37 by a ground bracket 41 and second pivot supporting leg 40 is mounted to support surface 37 by a ground bracket 42. Similar to pivot supporting central member 38, the first and second pivot supporting legs 39 and 40 each provide for up and down pivotal movement of the ends 32*a* and 33*b* of the first elongated plank 32 and the ends 34*a* and 34*b* of the third elongated plank 34 relative to the support surface 37. A feature of playground apparatus 31 is that unlike playground apparatus 10 of FIG. 1, the supporting legs 39 and 40 playground apparatus 31 are off set from center when playground apparatus 31 is in the rest condition so as to provide supporting legs 39 and 40 with a preloaded tension. Although supporting legs 39 and 40 may be off set from center at various distances, it has been discovered that an offset distance of 2 inches from center provides for adequate preloaded tension for playground apparatus 31.

In further regards to the pivot supporting legs 39 and 40, it is noted that pivot supporting legs 39 and 40 each includes an arm 39*a* and 40*a* extending from an end of pivot supporting legs 39 and 40 that is distal to ground brackets 41 and 42. Arm 39*a* of pivot supporting leg 39 functions by mating with a mounting bracket 441, located proximal the underside of first plank 32 to allow pivot supporting leg 39 to support first elongated plank 32 above support surface 37 while also providing for the pivotally movement of first elongated plank 32 thereabout. Likewise, arm 40*a* of pivot supporting leg 40 functions by mating with a mounting bracket 46 located proximal the underside of third plank 34 to allow pivot supporting leg 40 to support third elongated plank 34 above support surface 37 while also providing for the pivotally movement of third elongated plank 34 thereabout.

Figure 10:
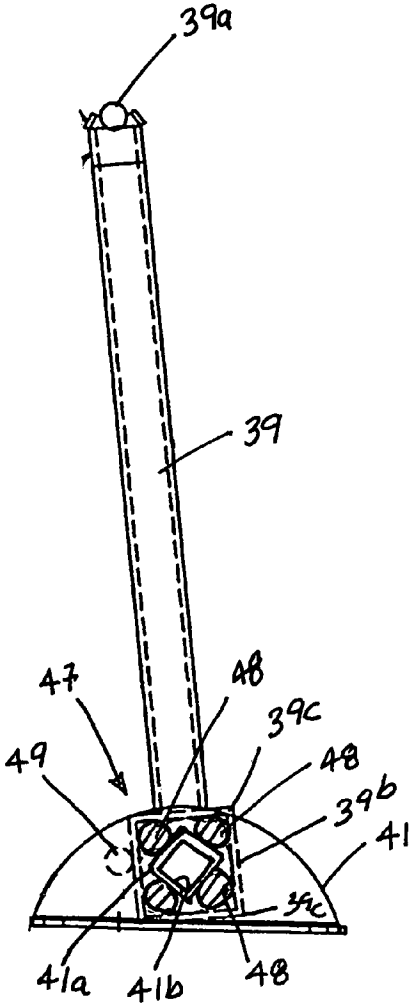
FIG. 10 shows a cross-sectional view of a first supporting leg of the playground apparatus of FIG. 8.
Figure 11:
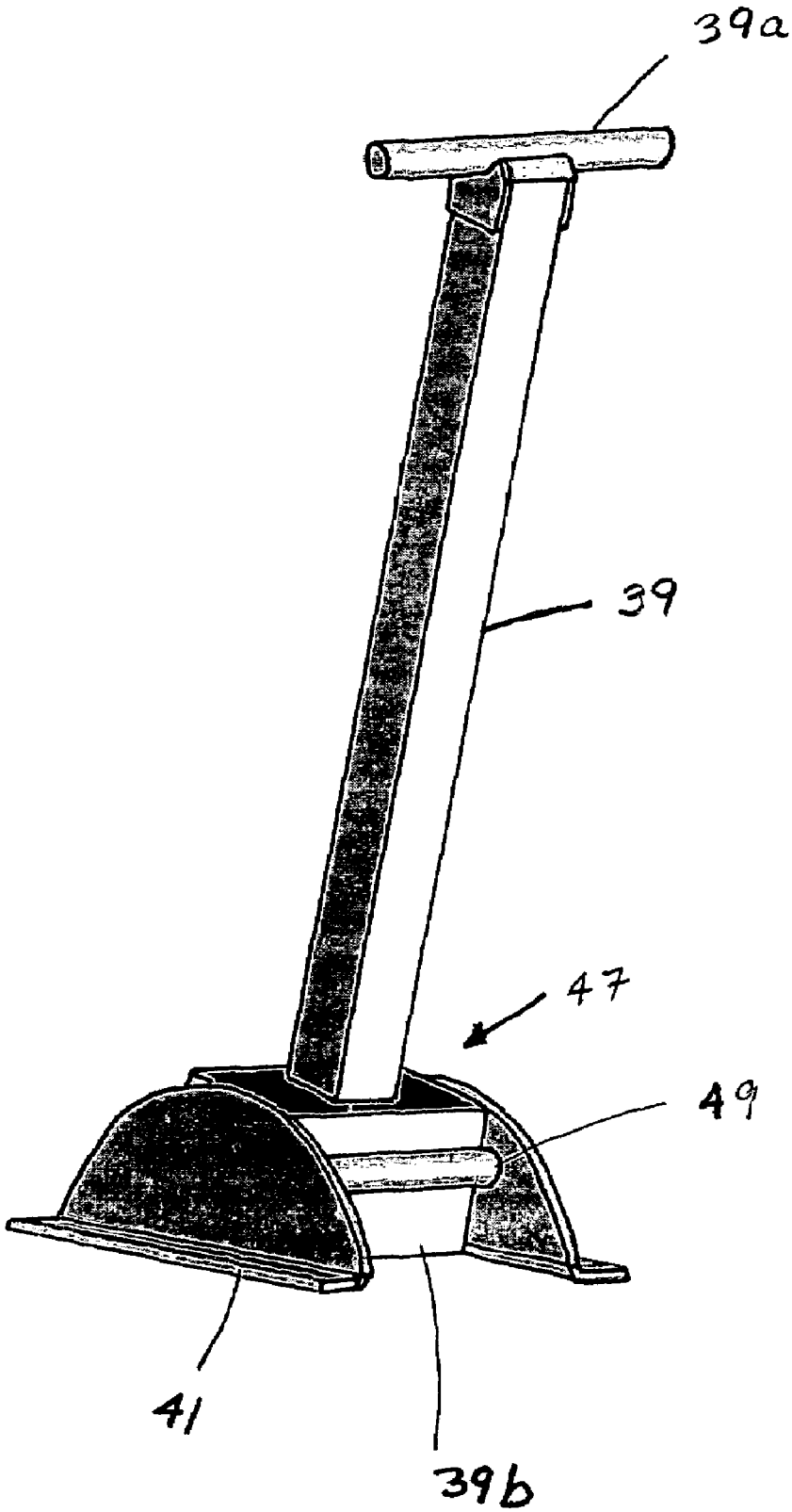
FIG. 11 shows a perspective view of the first supporting leg of the playground apparatus of FIG. 8.

Referring to FIGS. 10 and 11, FIG. 10 shows a cross-sectional view and FIG. 11 shows a perspective view of first supporting leg 39 of playground apparatus 31. It is noted that since supporting legs 39 and 40 have similar features and functions, only first supporting leg 39 will be described hereinafter in further detail. As shown in FIG. 10, a feature of the playground apparatus 31 is that the supporting leg 39 of playground apparatus 31 also includes a hollow arm 39*b* extending from an end of supporting leg 39 that is distal to arm 39*a*. Hollow arm 39*b* of supporting leg 39 functions by matingly encompassing and or engaging ground bracket 41, and more specifically, a bar 41*a* of ground bracket 41 located proximal the underside of second plank 33 to form a torsion axle 47 similar to the torsion axle 45 shown in FIG. 9. The mating between the bar 41*a* of ground bracket 41 and the hollow arm 39*b* of first supporting leg 39 allows for the pivotally movement of first supporting leg 39 about ground bracket 41.

Referring to FIG. 10, it is noted that similar to torsion axle 45, torsion axle 47 of FIG. 10 shows the bar 41*a* of ground bracket 41 and the hollow arm 39*b* of first supporting leg 39 both comprising a square shaped cross-section with hollow arm 39*b* positioned around bar 41*a* such that in a rest condition the sidewalls 41*b* of bar 41*a* faces the corners 39*c* of hollow arm 38*a*. In order to slow down and limit the pivotal motion of the first supporting leg 39 about ground bracket 41 in order to guard against potential injuries, torsion axle 47 includes a set of resiliently flexible damping members 48 positioned in the spaces formed between the sidewalls 41*b* of bar 41*a* and the corners 39*c* of hollow arm 39*b*. Although the range of pivotal motion of the first supporting leg 39 about ground bracket 41 can vary per design choice, preferably the range of pivotal motion of the first supporting leg 39 about ground bracket 41 should be about 22.5 degrees in either or each direction.

Referring to FIG. 11, as a safety pre-caution, the ground bracket 41 may also include a stop pin 49 located on the side of supporting leg 39 towards the center of the apparatus with stop pin 49 functioning to provide for a mechanical stop to prevent a free end 32*a* of the first plank 32 from reaching support surface 37 and potentially form a crushing point. Although one stop pin 49 is shown in FIGS. 10 and 11, alternative embodiment can include stop pins located on both sides of supporting leg 39.

I claim:

1. A playground apparatus comprising:

at least three separate elongated planks extending in a generally horizontally spaced end-to-end relationship, each of said elongated planks having a pivotal support member for pivotally supporting said elongated plank in vertically spaced relationship above a support surface for vertical pivotal movement of opposite ends of said elongated planks; and at least two resilient living hinges, each of said living hinge providing a continuously void-free connection between an end of one of said elongated plank to an end of another elongated plank so as to eliminate a pinch point while providing for simultaneous vertical movement of said elongated planks during use.

2. The playground apparatus of claim 1 wherein the elongated planks include integrated handles located on the sides of said elongated planks.

3. The playground apparatus of claim 1 wherein said resilient living hinges includes a cut resistance material implanted therein.

4. The playground apparatus of claim 1 wherein said at least three separate elongated planks comprises a first elongated plank supported by a first pivotal support member, a second elongated plank supported by a second pivotal support member, and a third elongated plank supported by a third pivotal support member.

5. The playground apparatus of claim 4 wherein said second pivotal support member includes a torsion axle located proximal said second elongated plank to allow for the pivotally movement of said second elongated plank about said second pivotal support member, said torsion axle includes a set of resiliently flexible damping members located therein to slow and limit the pivotal motion of said second elongated plank.

6. The playground apparatus of claim 4 wherein said first pivotal support member and said third pivotal support member are each offset from center towards said second pivotal support member in a rest condition to provide said first pivotal support member and said third pivotal support member with a preloaded tension.

7. The playground apparatus of claim 4 wherein said first pivotal support member and said third pivotal support member each include a torsion axle located proximal a support surface to allow for the pivotally movement of said pivotal support members.

8. The playground apparatus of claim 7 wherein said torsion axles of said first pivotal support member and said third pivotal support member each include a set of resiliently flexible damping members located therein to slow and limit the pivotal motion of said first and third pivotal support members.

9. The playground apparatus of claim 7 wherein each of said torsion axles include a stop pin to limit the pivotally movement of said pivotal support members.

10. A playground apparatus comprising:

at least three separate elongated planks extending in a generally horizontally spaced end-to-end relationship;

at least one pivotal support member for pivotally supporting each of said elongated plank in vertically spaced relationship above a support surface for vertical pivotal movement of opposite ends of said elongated planks; and at least two resiliently solid flexible living hinges, each of said living hinge providing a void-free connection between an end of one of said elongated plank to an end of another elongated plank so as to eliminate a pinch point while providing for simultaneous vertical movement of said elongated planks.

11. The playground apparatus of claim 10 wherein said at least three separate elongated planks comprises a first elongated plank supported by a first pivotal support member, a second elongated plank supported by a second pivotal support member, and a third elongated plank supported by a third pivotal support member.

12. The playground apparatus of claim 11 wherein said first pivotal support member and said third pivotal support member are each offset from center towards said second pivotal support member in a rest condition to provide said first pivotal support member and said third pivotal support member with a preloaded tension, said first pivotal support member and said third pivotal support member each including a torsion axle located proximal a support surface to allow for the pivotally movement of said pivotal support members.

13. The playground apparatus of claim 11 wherein said elongated planks are vertically support above a support surface to prevent the ends of said planks from forming a crushing point with said support surface.

14. The playground apparatus of claim 10 wherein said elongated planks are coated with a weatherproof material to extend the life of said elongated planks.

15. A playground apparatus comprising:

a first elongated plank, a second elongated plank, and a third elongated plank;

a first pivotal support member for pivotally supporting said first elongated plank, a second pivotal support member for pivotally supporting said second elongated plank, a third pivotal support member for pivotally supporting said third elongated plank whereby each of said elongated plank are pivotally supported in vertically spaced relationship above the ground for vertical pivotal movement of said opposite ends of said elongated planks; and first resiliently flexible solid living hinge connecting an end of said first elongated plank to an end of said second elongated plank, and a second resiliently flexible solid living hinge connecting an end of said second elongated plank to an end of said third elongated plank, said solid living hinge providing a void-free connection between said ends of said elongated plank so as to eliminate a pinch point while providing for simultaneous vertical movement of said elongated planks.

16. The playground apparatus of claim 15 wherein the elongated planks includes integrated handles located on the sides of said elongated planks.

17. The playground apparatus of claim 15 wherein said resilient living hinges includes a plurality of cut resistant wires implanted therein.

18. The playground apparatus of claim 15 wherein said second pivotal support member includes a torsion axle located proximal said second elongated plank to allow for the pivotally movement of said second elongated plank about said second pivotal support member, said torsion axle includes a set of resiliently flexible damping members located therein to slow and limit the pivotal motion of said second elongated plank.

19. The playground apparatus of claim 18 wherein said first pivotal support member and said third pivotal support member are each offset from center towards said second pivotal support member in a rest condition to provide said first pivotal support member and said third pivotal support member with a preloaded tension.

20. The playground apparatus of claim 19 wherein said first pivotal support member and said third pivotal support member each include a torsion axle located proximal a support surface to allow for the pivotally movement of said pivotal support members, said torsion axles of said first pivotal support member and said third pivotal support member each having a set of resiliently flexible damping members located therein to slow and limit the pivotal motion of said first and third pivotal support member

* * * * *